US007452229B2

(12) United States Patent
Hsu et al.

(10) Patent No.: US 7,452,229 B2
(45) Date of Patent: Nov. 18, 2008

(54) ELECTRICAL CONNECTOR FOR RECEIVING AN ELECTRICAL MODULE

(75) Inventors: Chien-Yu Hsu, Gueishan Township, Taoyuan County (TW); Robert Chiang, Gueishan Township, Taoyuan County (TW)

(73) Assignee: Speed Tech Corp., Taoyuan County (TW)

( * ) Notice: Subject to any disclaimer, the term of this patent is extended or adjusted under 35 U.S.C. 154(b) by 0 days.

(21) Appl. No.: 11/723,754

(22) Filed: Mar. 21, 2007

(65) Prior Publication Data

US 2008/0233797 A1 Sep. 25, 2008

(51) Int. Cl.
*H01R 13/62* (2006.01)

(52) U.S. Cl. ..... 439/330; 439/70

(58) Field of Classification Search ..... 439/70, 439/71, 330, 607

See application file for complete search history.

(56) References Cited

U.S. PATENT DOCUMENTS 7,156,679 B1 * 1/2007 Wang et al. ..... 439/330
7,241,160 B2 * 7/2007 Yang ..... 439/330

* cited by examiner

*Primary Examiner*—Tho D Ta
(74) *Attorney, Agent, or Firm*—Troxell Law Office, PLLC

(57) ABSTRACT

An electrical connector for receiving an electrical module. The electrical module has a convex on a lateral surface. The electrical connector comprises an insulated housing, a plurality of terminals and a metallic shell. The insulated housing has at least a stop wall on an edge and has an indentation corresponding to the convex. The terminals are set in the insulated housing separately. The metallic shell completely surrounds both the insulated housing and the electrical module to avoid operations of the electrical module from being affected by exterior electromagnetic waves.

11 Claims, 9 Drawing Sheets

ELECTRICAL CONNECTOR FOR RECEIVING AN ELECTRICAL MODULE

FIELD OF THE INVENTION

The present invention relates to an electrical connector for receiving an electrical module; more particularly, relates to an electrical connector having an insulated housing surrounded by a metallic shell.

DESCRIPTION OF THE RELATED ART

A prior art of an electrical connector with an anti-mismating arrangement, where U.S. Pat. No. 6,939,172 is designated for "an electrical module with an anti-mismating convex", is shown in FIG. 9. The prior art comprises an insulated housing 6, a plurality of contacts 7 and a metallic shield 8, where the contacts 7 are held by the insulated housing 6. An end of each contact 7 is stretched out of the insulated housing 6 to be electrically connected with a circuit board (not shown in the figure). The shield 8, interfered with the insulated housing 6, surrounds the insulated housing 6 and is fixed at outside of the insulated housing 6. A camera module 9 is held in the electrical connector after the electrical connector is deployed on a printed circuit board (PCB). Each contact 7 has another end that is other than the end, which is connected to the circuit board; and the other end is electrically connected with the camera module 9. The camera module 9 has a projecting portion 91. The shield 8 has a cutout 81 corresponding to the projecting portion 91. And two sides of the cutout 81 are fastened with a clasping portion 82. When the camera module 9 is put into the shield 8, the projecting portion 91 is projected out of the cutout 81 and is butted against the clasping portion 82.

The shield 8 is mainly used to avoid operations of the camera module 9 from being affected by exterior electromagnetic waves. Yet the projecting portion 91, in said US patent, is projected out of the shield 8. Even though the two sides of the cutout 81 are fastened with the clasping portion 82 to reduce the area where the camera module 9 is exposed out of the shield 8, the problem is not fully solved. Besides, the clasping portion 82 is fabricated through stretching, where precision for the clasping portion 82 is hard to be controlled through stretching during the mass production. Thus, the yielding capacity of the shield 8 is reduced, not to mention the structure is weaker. Hence, the prior art does not fully fulfill users' requests on actual use.

SUMMARY OF THE INVENTION

The main purpose of the present invention is to provide an electrical connector with a metallic shell, which completely surrounds an electrical module so that, when the electrical module operates, exterior electromagnetic waves do not affect the operations.

Another purpose of the present invention is to improve the yielding capacity of the metallic shell.

To achieve the above purposes, the present invention is an electrical connector for receiving an electrical module, where the electrical module has a convex on a surface. The electrical connector comprises an insulated housing, a plurality of terminals and a metallic shell, where the insulated housing has at least one stop wall formed on an edge; where the stop wall has an indentation for receiving the convex on the surface of the electrical module; where the metallic shell completely surrounds the insulated housing to avoid operations of the electrical module from being affected by exterior electromagnetic waves after the electrical module is received and assembled in the electrical connector; and where the yielding capacity of the metallic shell is improved. Accordingly, a novel electrical connector for receiving an electrical module is obtained.

BRIEF DESCRIPTIONS OF THE DRAWINGS

The present invention will be better understood from the following detailed descriptions of the preferred embodiments according to the present invention, taken in conjunction with the accompanying drawings, in which FIG. 1 is the perspective view showing the first preferred embodiment according to the present invention;

DESCRIPTIONS OF THE PREFERRED EMBODIMENTS

The following descriptions of the preferred embodiments are provided to understand the features and the structures of the present invention.

Figure 1:
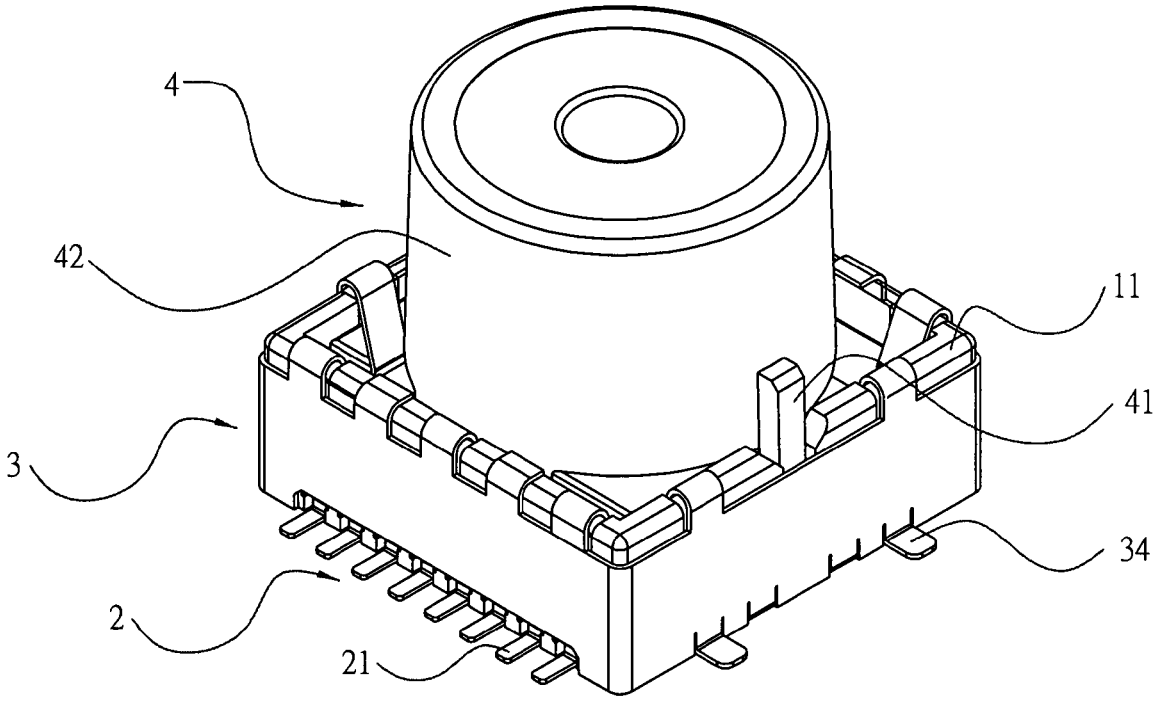
Figure 2:
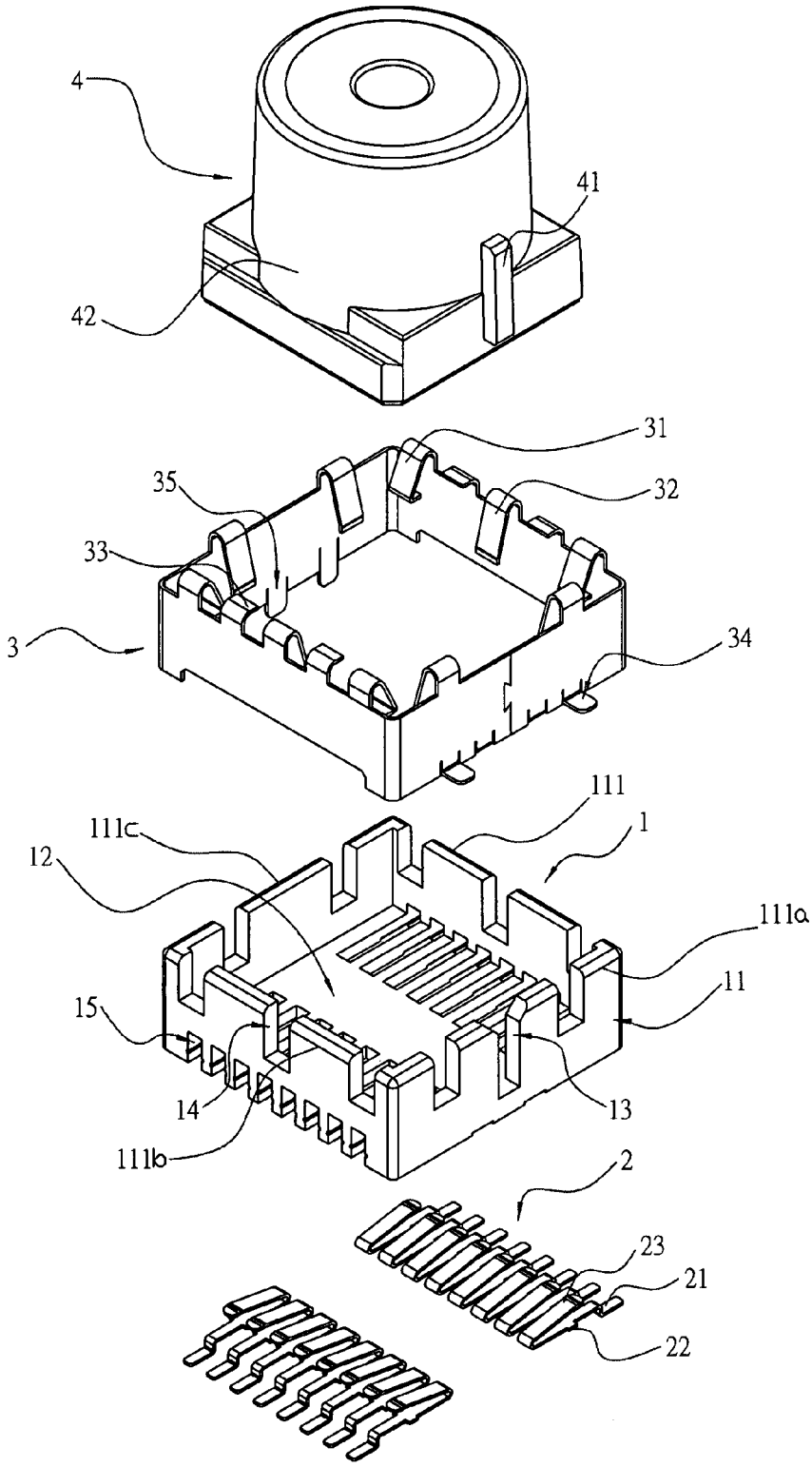
FIG. 2 is the explosive view showing the first preferred embodiment.

Please refer to FIG. 1 and FIG. 2, which are a perspective view and an explosive view showing a first preferred embodiment according to the present invention, respectively. As shown in the figures, the present invention is an electrical connector, deposed on a printed circuit board PCB), for receiving an electrical module 4, which has a convex 41 on a surface. The electrical connector according to the present invention comprises an insulated housing 1, a plurality of terminals 2 and a metallic shell 3 to completely surround both the insulated housing 1 and the electrical module 4 so as to avoid operations of the electrical module 4 from being affected by exterior electromagnetic waves after the electrical module 4 is assembled in the electrical connector.

The insulated housing 1 has at least one stop wall 11 formed on an edge away from the PCB. The stop wall 11 comprises, for example, in this embodiment, four continuous partitioning walls 111, 111*a*, 111*b*, 111*c*, where a receiving area 12 is defined on the insulated housing 1 by the stop wall 11. One of the partitioning walls 111*a* has an indentation 13, for example, in this embodiment, which is corresponding to the convex 41 on the lateral surface of the electrical module 4. The stop wall 11 has a plurality of openings 14. The insulated housing 1 has a plurality of slots 15 communicating to the receiving area 12.

The terminals 2 are held in the slots 15 of the insulated housing 1 separately by interfering with the lots 15, for example; and each terminal 2 comprises a soldering section 21, an interfering section 22 and a contacting section 23, where the soldering section 21 is extended out of the insulated housing 1 for connecting to electrical circuits on the PCB; where the interfering section 22 is interfered with the slot 15 for holding each terminals 2 onto the housing 1; and where the contacting section 23 is extended into the receiving area 12 for connecting to the electrical module 4.

The metallic shell 3, formed by cutting and bending a metal sheet, completely surrounds the stop wall 11. There are a plurality of pressing springs 31 and a plurality of pushing springs 32 on an edge of the metallic shell 3, and both of the springs 31 and 32 are extended toward the receiving area 12. The metallic shell 3 is set with a plurality of buckles 33 on an edge of the metallic shell 3 to be buckled on an edge of the stop wall 11. The metallic shell 13 has a plurality of grounding tabs 34 and a plurality of hooking claws 35 on another edge of the metallic shell 3. The metallic shell 13 according to the present invention surrounds the insulated housing 1 without stretching. Thus, the yielding capacity of the metallic shell 3 is improved.

The electrical module 4 received and assembled into the receiving area 12 of the electrical connector is electrically connected with the contacting sections 23 of the terminals 2. The electrical module 4 has the convex 41 on the lateral surface of the electrical module 4, correspondingly con joining the indentation 13 of the stop wall 11. The electrical module 4 has a grounding section 42 on the outer surface, where the grounding section 42 is a metal paint or is surrounded by a conductive material. The pressing springs 31 and the pushing springs 32 are butted against the grounding section 42 on a lateral surface of the electrical module 4. Hence, the co-operation between the metallic shell 3 of the electrical connector and the grounding section 42 of the electrical module 4 prevents the electrical module 4 from being affected by the exterior electromagnetic waves. Thus, with the above structure, a novel electrical connector for receiving an electrical module is obtained.

In the electrical connector, according to the embodiment of the present invention, the pressing springs 31 are designated for pressing the electrical module 4 toward the contacting sections 23 of the terminals 2. Therefore, the electrical module 4 is electrically connected with the contacting sections 23 of the terminals 2 securely. The pushing springs 32 are formed from the metallic shell 3 to obtain a pre-load stress to push the lateral surfaces of the electrical module 4. Thus, the pushing springs 32 keep the electrical module 4 away from the stop wall 11 where the stop wall 11 comprises four partitioning walls 111, 111*a*, 111*b*, 111*c*, for example, in this embodiment. The pushing springs 32 prevent the electrical module 4 in the electrical connector from breaking the contacting sections 23 owing to, for example, a sudden quake happened in an environment. Accordingly, if all what requires is to transfer the electric charge from the grounding section 42 of the electrical module 4 to the metallic shell 3, it is known that only either the pressing springs 31 or the pushing springs 32 need to be butted against the grounding sections 42.

Figure 3:
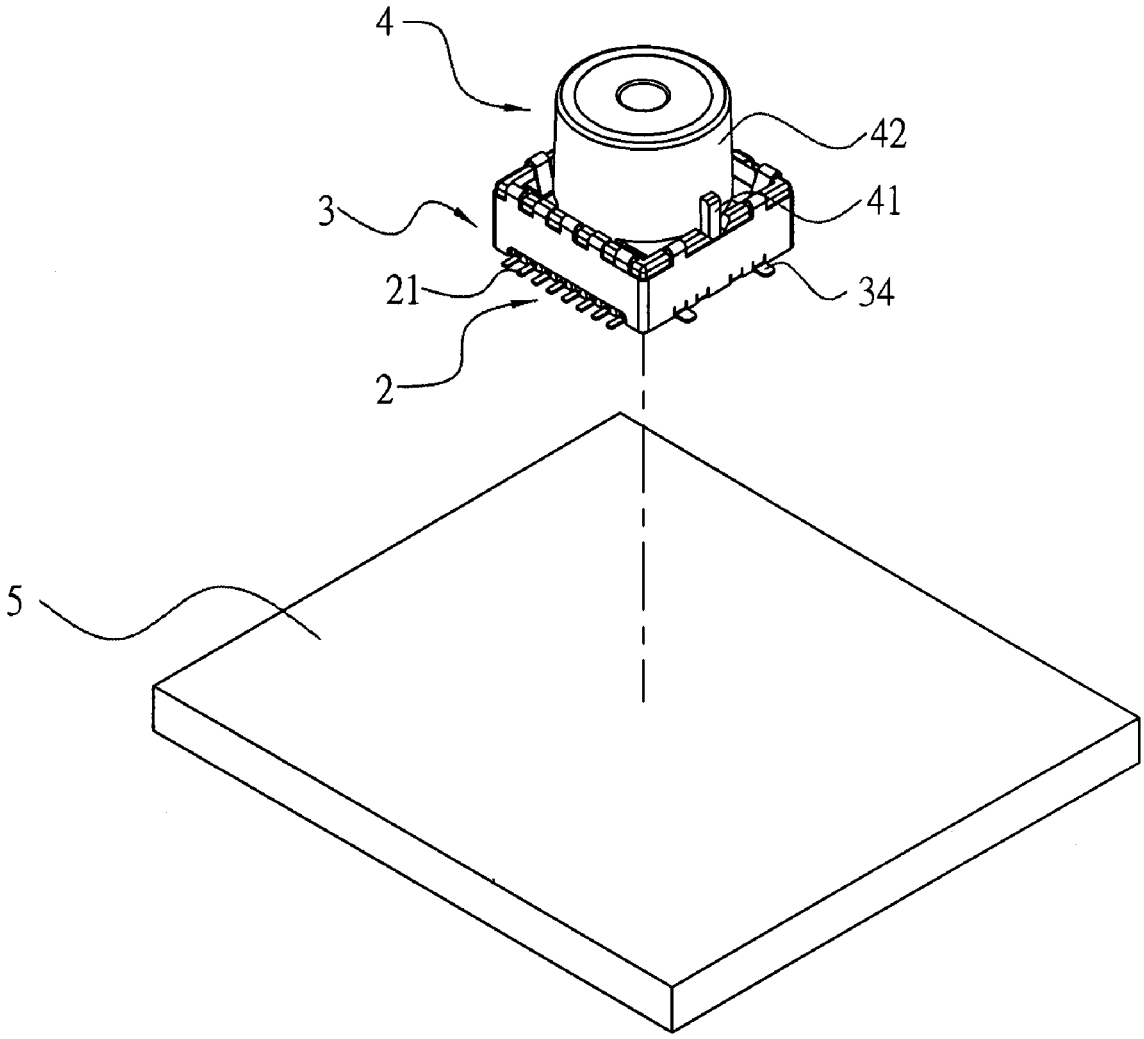
FIG. 3 is the perspective view showing the state of use of the first preferred embodiment.
Figure 4:
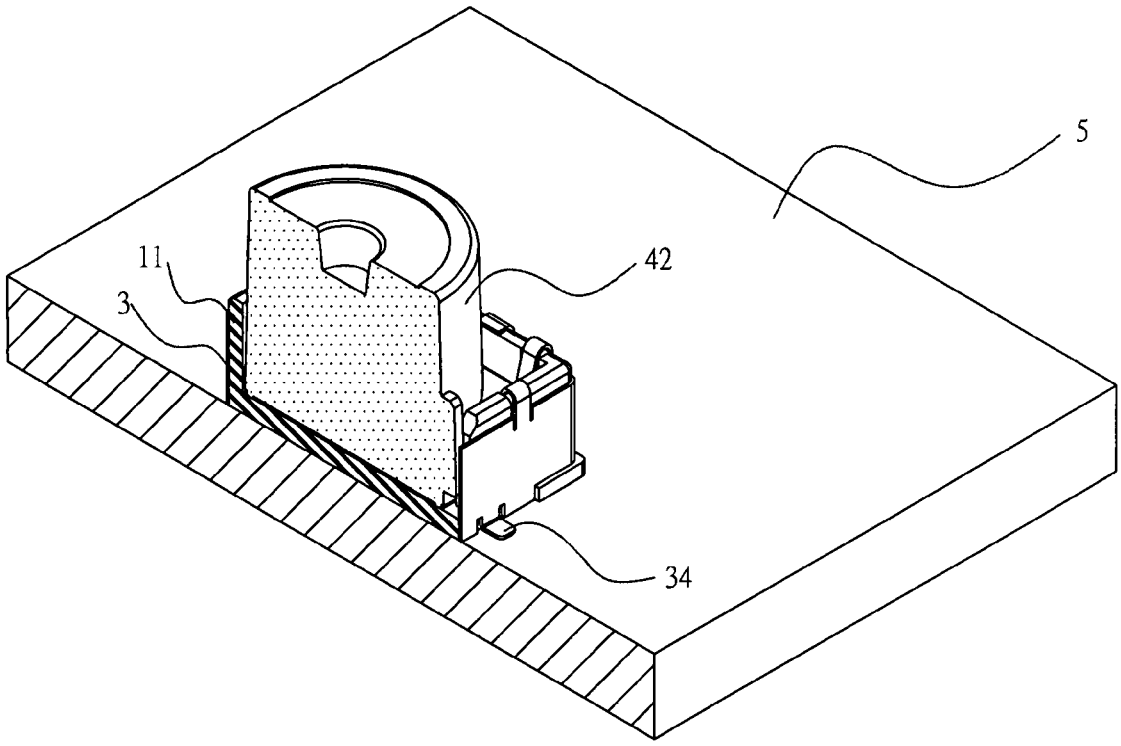
FIG. 4 is the explosive view showing the state of use of the first preferred embodiment.

Please refer to FIG. 3 and FIG. 4 together with FIG. 1 and FIG. 2, where FIG. 3 and FIG. 4 are a perspective view and an explosive view showing a state of use of the first preferred embodiment respectively. As shown in the figures, on assembling the present invention, a metallic shell 3 mainly surrounds an insulated housing 1 where buckles 33 are buckled on a top edge of the stop wall 11. The metallic shell 3 has a plurality of springs, including pressing springs 31 and pushing springs 32, both being correspondingly extended through corresponding openings 14 on the stop wall 11 to the receiving area 12. The metallic shell 13 also has a plurality of hooking claws 35 bended toward bottom of the receiving area 12 of the insulated housing 1 to hook at the bottom of the insulated housing 1 to fix the metallic shell 3 on the insulated housing 1. Then an electrical module 4 is received and assembled into the receiving area 12 of the insulated housing 1. A convex 41 of the electrical module 4 is correspondingly con joined with an indentation 13 of the stop wall 11; where each terminal 2 has a contacting section 23 to be electrically connected with the electrical module 4; and where the pressing springs 31 and the pushing springs 32 are butted against grounding sections 42 of the electrical module 4. The pressing springs 31 ensure the electrical module 4 to be connected with the contacting sections 23 of the terminals 2, where the pushing springs 32 finely dispose the electrical module 4 at a proper position relating to the metallic shell 3 and the insulated housing 1.

On using the present invention a soldering section 21 of each terminal 2 is electrically connected with a circuit board 5, where a plurality of grounding tabs 34 of the metallic shell 3 are electrically connected with a grounding circuit of the circuit board 5. Thus, the metallic shell 3 completely surrounds both the insulated housing 1 and the electrical module 4. And operations of the electrical module 4 are prevented from being affected by exterior electromagnetic waves.

The stop wall 11 of the insulated housing 1 comprises, for example, four continuous partitioning walls 111, 111*a*, 111*b*, 111*c*; and at least one partitioning wall 111*a* has an indentation 13, for example. The area where the circuit board 5 occupied by the electrical connector according to the present invention is reduced when the partitioning walls 111, 111*a*, 111*b*, 111*c* are decreased in number. Thus, the stop wall 11 comprises at least one partitioning wall 111*a*, for example where the partitioning wall 111*a* has an indentation 13; and the receiving area 12 is located right next to the partitioning wall 111*a*.

Figure 5:
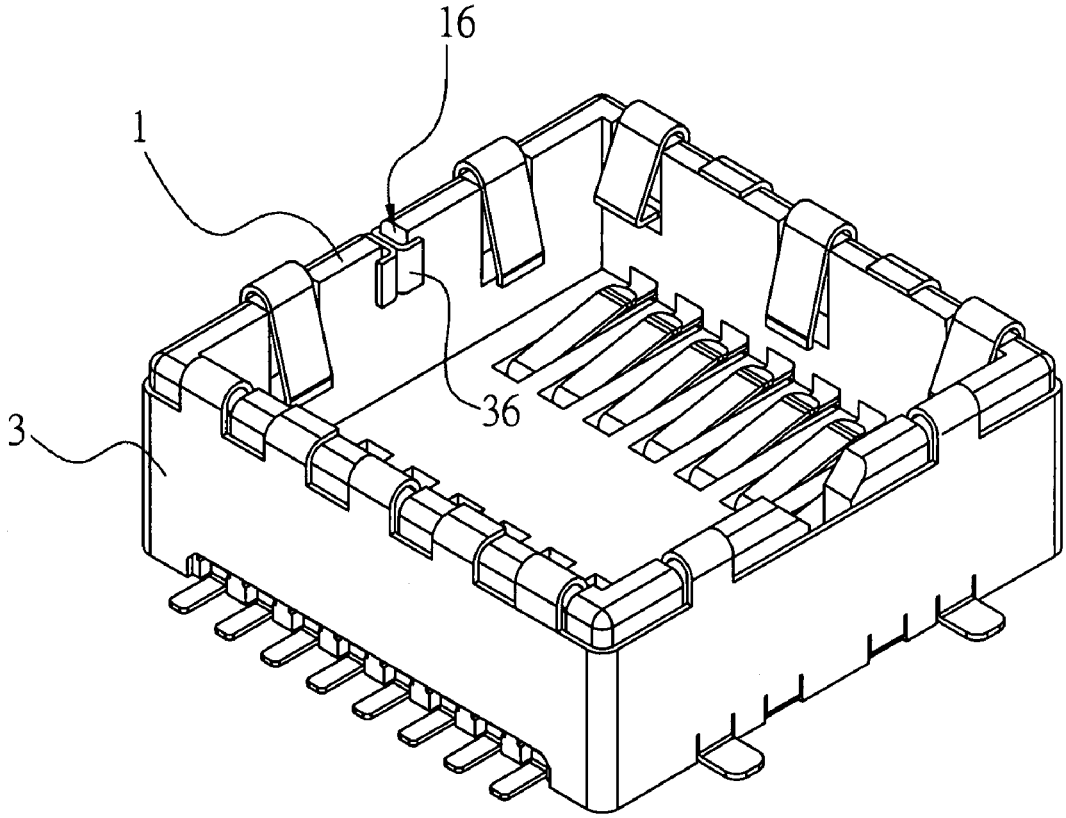
FIG. 5 is the perspective view showing the second preferred embodiment.
Figure 6:
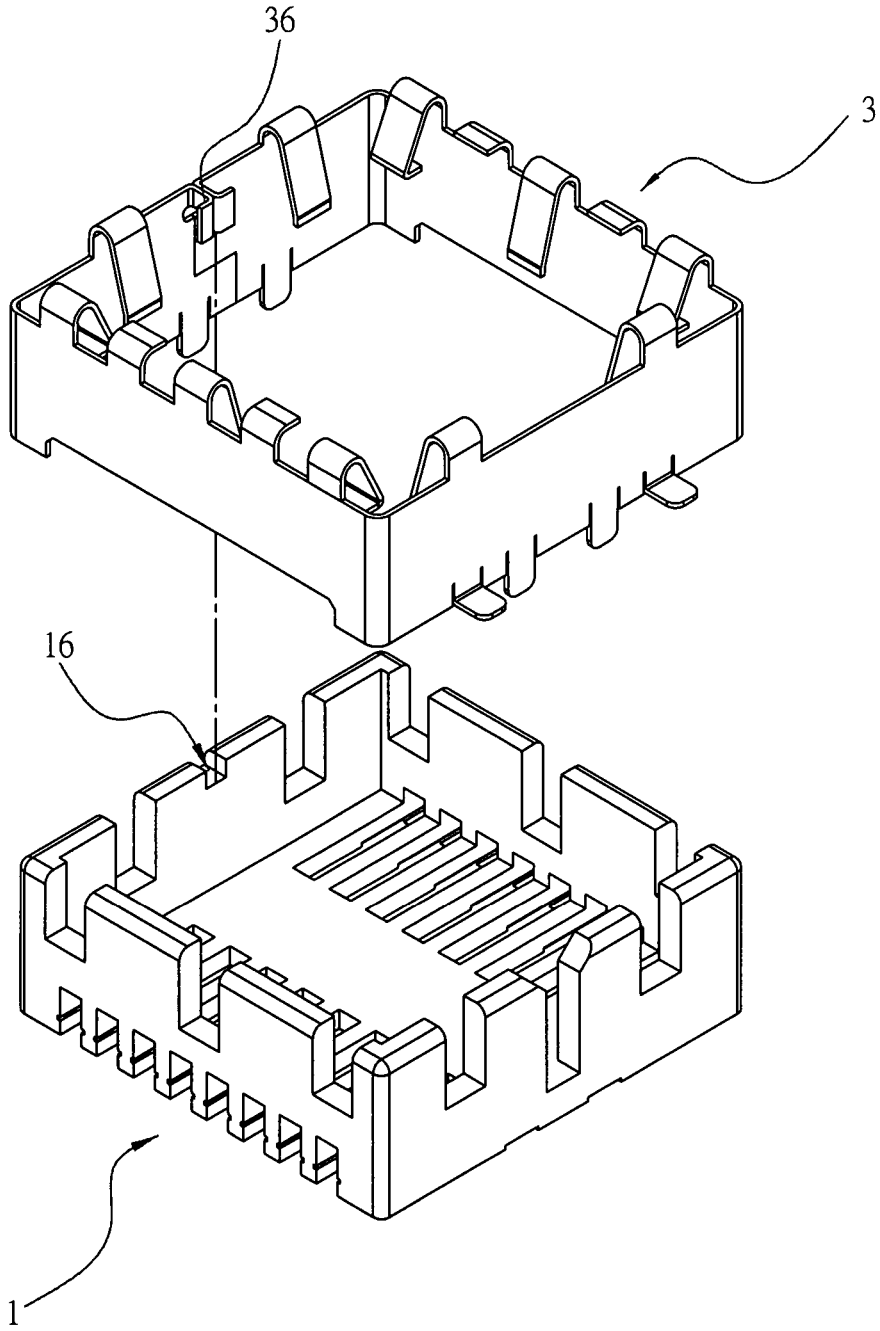
FIG. 6 is the explosive view showing the second preferred embodiment.

Please refer to FIG. 5 and FIG. 6 together with FIG. 1 and FIG. 2, where FIG. 5 and FIG. 6 are a perspective view and an explosive view showing a second preferred embodiment respectively. As shown in the figures, on assembling an insulated housing 1 together with a metallic shell 13 according to the present invention, at least one concave 16 formed at least one end of the metallic shell 13 is set on a stop wall 11 of the insulated housing 1 at places other than where the indentation 13 is set. The metallic shell 3 is cut and bended to obtain at least one buckling section 36 corresponding to the concave 16 of the stop wall 11. Thus, when the metallic shell 3 is assembled together with the insulated housing 1, each buckling section 36 is correspondingly buckled into the concave 16 of the stop wall 11, so that the metallic shell 3 is firmly fixed at outside of the insulated housing 1. And the buckling sections 36 are acted as springs, such as pressing springs or pushing springs which is formed on the metallic shell 3 and each one is at least partially extended into the receiving area 12.

Figure 7:
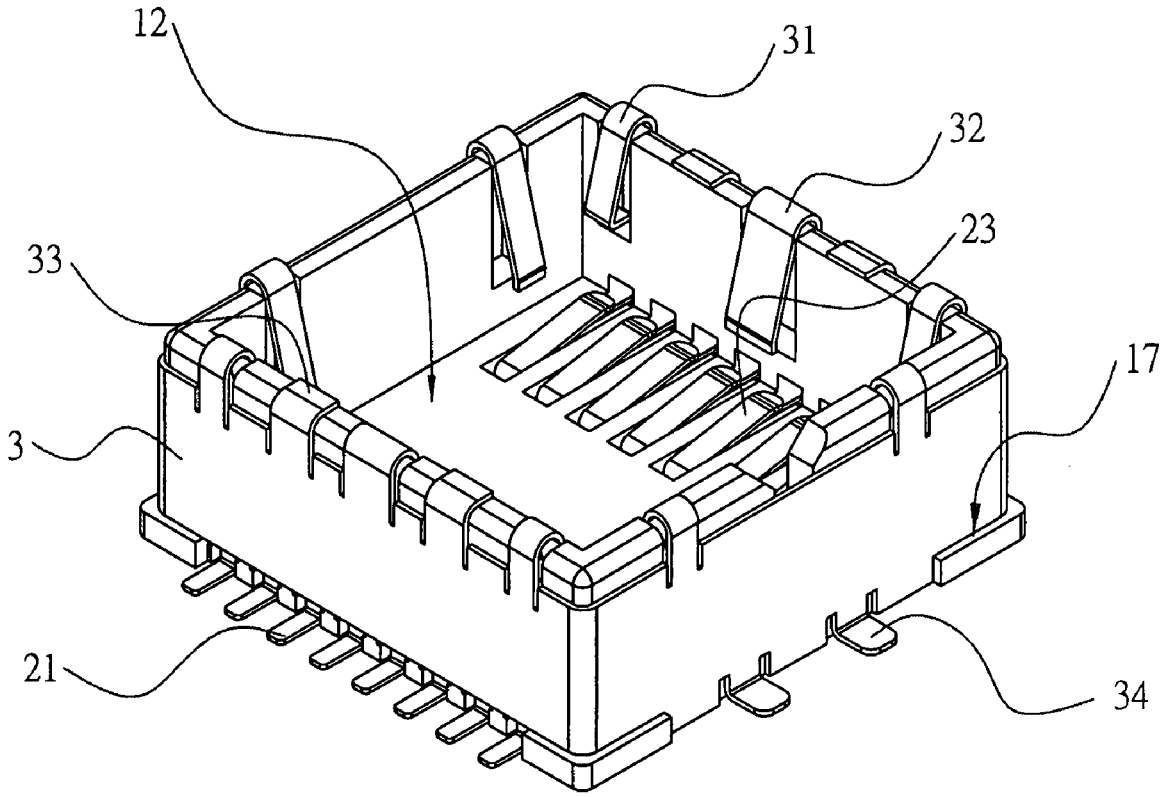
FIG. 7 is the perspective view showing the third preferred embodiment.
Figure 8:
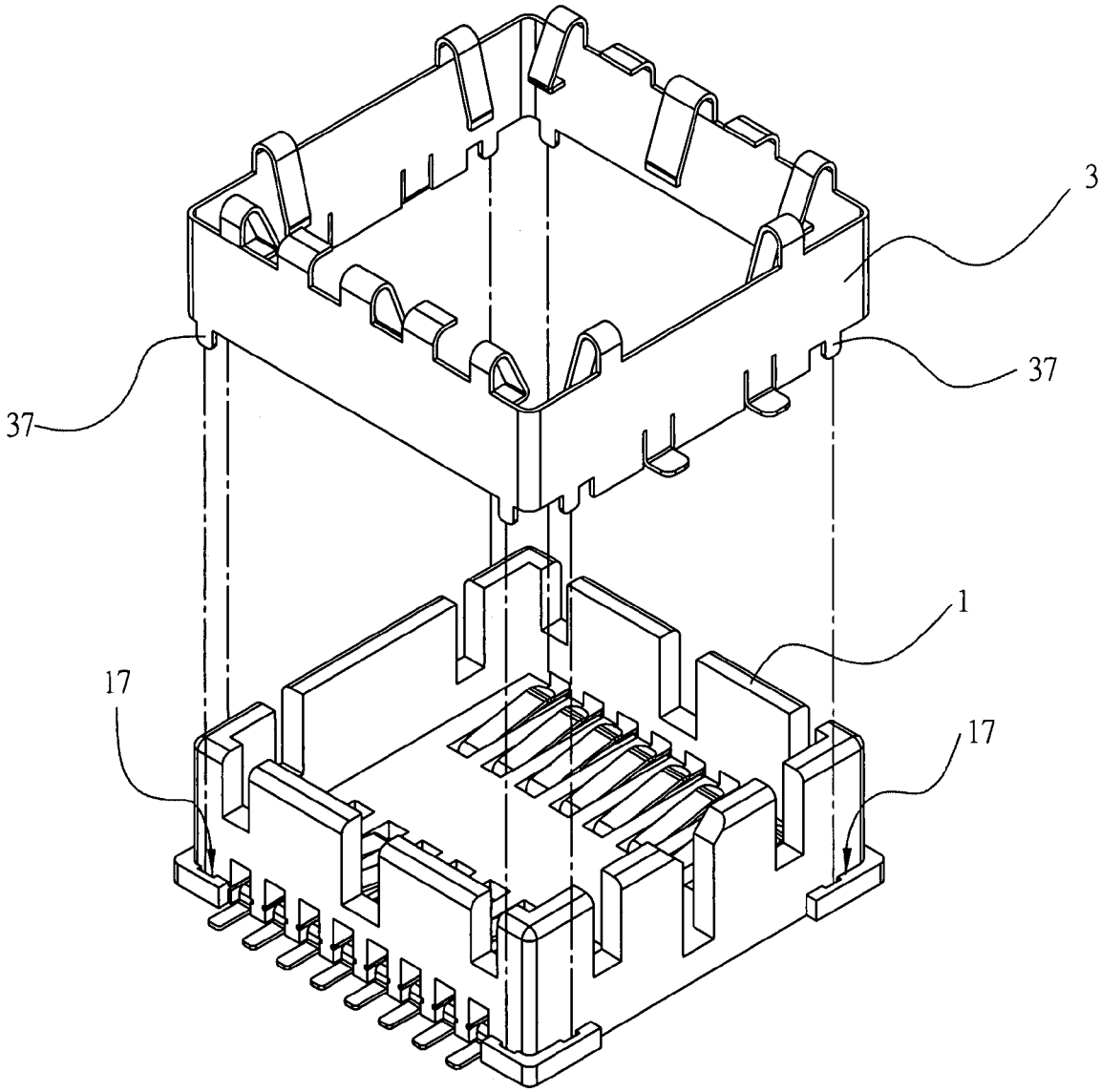
FIG. 8 is the explosive view showing the third preferred embodiment.
Figure 9:
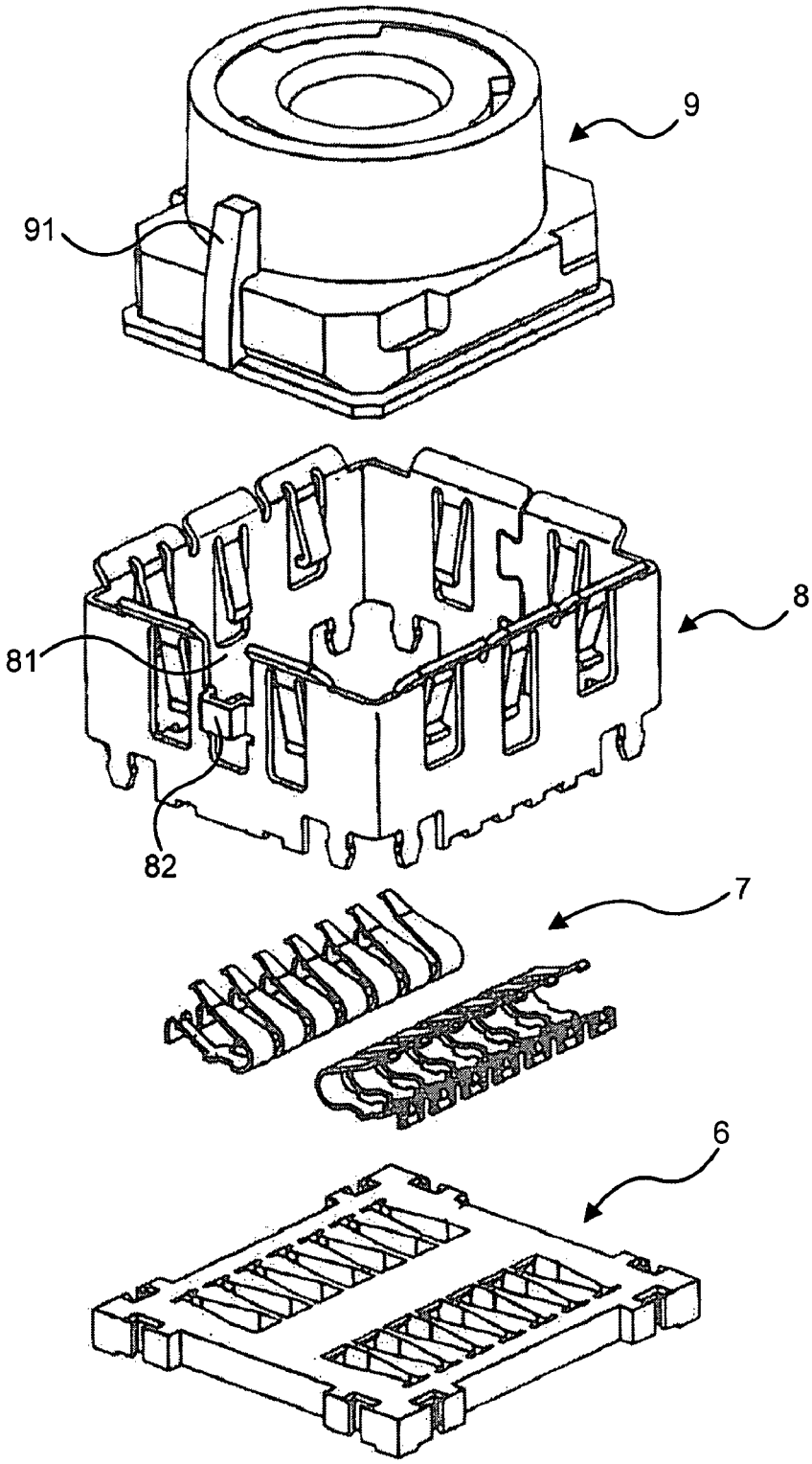
FIG. 9 is the explosive view of the prior art.

Please refer to FIG. 7 and FIG. 8 together with FIG. 1 and FIG. 2, where FIG. 7 and FIG. 8 are a perspective view and an explosive view showing a third preferred embodiment respectively. As shown in the figures, for assembling a metallic shell 3 to an insulated housing 1, a stop wall 11 of the insulated housing 1 has a plurality of interfering holes 17 adjacent to a lower edge of the stop wall 11; and the metallic shell 13 has a plurality of interfering pins 37 corresponding to the interfering holes 17, where the interfering pins 37 are formed on a lower edge of the metallic shell 3 at a direction toward the interfering holes 17 of the insulated housing 1. When the metallic shell 3 is assembled onto the insulated housing 1, the interfering pins 37 are interfered with the interfering holes 17 respectively so as to fix the metallic shell 3 at outside of the insulated housing 1.

To sum up, the present invention is an electrical connector for receiving an electrical module, where a metallic shell completely surrounds both an insulated housing and an electrical module so as to avoid operations of the electrical module from being affected by exterior electromagnetic waves; and where the yielding capacity of the metallic shell is improved.

The preferred embodiments herein disclosed are not intended to unnecessarily limit the scope of the invention. Therefore, simple modifications or variations belonging to the equivalent of the scope of the claims and the instructions disclosed herein for a patent are all within the scope of the present invention.

What is claimed is:

1. An electrical connector for receiving an electrical module, said electrical connector being deposed on a circuit board, said electrical module having at least one convex on a lateral surface, said electrical connector comprising:

an insulated housing, said insulated housing having at least a stop wall, being extended from said insulated housing, defining a receiving area on the insulated housing; and a plurality of slots;

a plurality of terminals, being disposed in said slots of said insulated housing respectively, each terminal having a soldering section, being extended to said circuit board;

an interfering section, being interfered with said slot; and a contacting section, being extended into said receiving area; and a metallic shell, said metallic shell completely surrounding said insulated housing, and said metallic shell having at least one spring extended into said receiving area, wherein said stop wall of said insulated housing has at least one indentation for receiving said convex of said electrical module, wherein said metallic shell has interfering pins on an edge of said metallic, shell;

wherein said insulated housing has interfering holes separately corresponding to said interfering pins;

wherein said interfering pins are interfered with said interfering holes to fix said metallic shell at outside of said insulated housing;

wherein the plurality of interfering holes are located adjacent to a lower edge of the stop wall, and wherein said interfering pins are formed on an edge of said metallic shell at a direction toward said interfering holes.

2. The electrical connector according to claim 1, wherein said stop wall comprises two corresponding partitioning walls; and wherein said receiving area is defined between said partitioning walls.

3. The electrical connector according to claim 1, wherein said stop wall comprises four partitioning walls; and wherein said receiving area is defined by said partitioning walls.

4. The electrical connector according to claim 1, wherein said stop wall has at least one opening corresponding to said spring.

5. The electrical connector according to claim 1, wherein said spring is a pressing spring; and wherein said pressing spring is butted against a surface of said electrical module to press said electrical module to be electrically connected with said contacting sections of said terminals.

6. The electrical connector according to claim 1, wherein said spring is a pushing spring; and wherein said pushing spring is butted against a lateral surface of said electrical module to keep said electrical module away from said stop wall.

7. The electrical connector according to claim 1, wherein said metallic shell is obtained by cutting and bending a metal sheet.

8. The electrical connector according to claim 1, wherein said metallic shell has buckles on an edge of said metallic shell and has hooking claws on another edge of said metallic shell;

wherein said buckles are extended toward a top edge of said insulated housing; and wherein at least a part of said hooking claws are bended toward bottom of said receiving area of said insulated housing to fix said metallic shell on said insulated housing.

9. The electrical connector according to claim 1, wherein said metallic shell extends a plurality of grounding tabs to be electrically connected with said circuit board.

10. The electrical connector according to claim 1, wherein said metallic shell is cut and bended to obtain at least one buckling section.

11. The electrical connector according to claim 10, wherein said stop wall has at least one concave corresponding to said buckling section; and wherein said buckling section is buckled into said concave so as to keep said metallic shell being fixed at outside of said insulated housing.

* * * * *